US005846049A

United States Patent [19]

DuPuis

[11] Patent Number: 5,846,049

[45] Date of Patent: Dec. 8, 1998

[54] MODULAR CONTAINMENT APPARATUS FOR ADJUSTING AXIAL POSITION OF AN IMPELLER IN A MAGNETICALLY COUPLED APPARATUS

[75] Inventor: Francis A. DuPuis, Whitehouse Station, N.J.

[73] Assignee: Endura Pumps International, Inc., Garwood, N.J.

[21] Appl. No.: 676,421

[22] Filed: Jul. 8, 1996

[51] Int. Cl.[6] ..... F01D 7/00

[52] U.S. Cl. ..... 415/131; 415/173.2; 415/174.3; 417/423.11

[58] Field of Search ..... 415/131, 132, 415/173.2, 174.1, 175, 180, 129; 417/423.11, 423.13, 423.14, 423.8, 420

[56] References Cited

U.S. PATENT DOCUMENTS 3,420,184 1/1969 Englesberg et al. ..... 417/420
3,771,927 11/1973 Schiller ..... 415/131
3,801,215 4/1974 Osborne ..... 415/131
4,509,773 4/1985 Wentworth ..... 277/380
5,288,213 2/1994 Nasr ..... 417/368
5,368,439 11/1994 Piazza ..... 415/131

*Primary Examiner*—Edward K. Look
*Assistant Examiner*—Richard Woo
*Attorney, Agent, or Firm*—Paul J. Cook

[57] ABSTRACT

A pump is provided which includes an axially adjustable impeller in order to adjust the distance between the impeller and a housing section adjacent the impeller and thereby increase pump efficiency. The pump also can be made to have a removable module including the impeller, a shaft for the impeller and an impeller driving member positioned on the shaft.

75 Claims, 9 Drawing Sheets

MODULAR CONTAINMENT APPARATUS FOR ADJUSTING AXIAL POSITION OF AN IMPELLER IN A MAGNETICALLY COUPLED APPARATUS

BACKGROUND OF THE INVENTION

This invention relates to a modular containment apparatus for adjusting the axial position of an impeller in an apparatus for moving a fluid with an impeller such as a pump or a compressor. More particularly, this invention relates to a modular apparatus for axially adjusting the position of an impeller which apparatus can be replaced by a like module after the serviceable period for the module has ended.

At the present time, the clearance between an impeller and housing for the impeller is fixed in a wide variety of available pumps and compressors. Pump pressure, as a function of fluid flow rate through the pump, is highly dependent upon the clearance between the impeller and the housing for the impeller. Therefore, it is desirable to have the capability to adjusting this clearance thereby to improve efficiency .

It has been proposed in U.S. Pat. No. 5,368,439 to provide a means for axially adjusting an impeller in a magnetic drive pump. The impeller is positioned on one end of a shaft while the opposing end of the shaft is threaded. A nut is provided on the threaded end of the shaft which, when turned, functions to axially position the impeller within the impeller housing. The position of the nut and the threaded end of the shaft is fixed by means of a set screw which cooperates with the nut. After the impeller has been properly positioned, the end of the shaft remote from the impeller is sealed by means of a can or the like which separates the driving magnets connected to a power source from the driven magnets positioned within the can and attached to the shaft to effect shaft rotation. In an alternative means for axially adjusting the position of an impeller in a pump is by way of the use of shims.

Presently available means for axially adjusting an impeller are formed integrally with the pump apparatus and, when the pump apparatus experiences excessive wear, the entire pump must be replaced.

Accordingly, it would be desirable to provide a means for adjusting the axial position of an impeller in a compressor, pump or the like which permits adjusting the axial position of the impeller. In addition, it would be desirable to provide a compressor, pump or the like which is modular in construction and which can be replaced after excessive wear has occurred without the need for replacing major portions of a housing for the impeller or other major portions of a pump or a compressor utilizing the impeller. It would also be desirable to provide a means for rendering the portion of the pump comprising the high maintenance elements including the impeller as a single unit so that they can be replaced in one step rather than piecemeal in order to provide economy for the replacement procedure. Such a modular means for adjusting the axial position of an impeller would provide substantial economic benefits.

SUMMARY OF THE INVENTION

In accordance with this invention, an apparatus is provided for moving of fluid under pressure which utilizes a stationary housing, a rotatable shaft having a free end positioned within the housing and an impeller mounted on a second end of the shaft and rotatably mounted within the housing. The apparatus of this invention is provided with means for adjusting the axial position of the impeller along the direction of the major axis of the rotatable shaft within the housing. The free end is magnetically coupled to a magnetic drive. The free end is positioned within a can housing while the magnetic drive is positioned outside the can housing. The purpose of the axial adjustment capability is to adjust the distance between the impeller and an inner surface of the housing to define a space through which a fluid is passed under the pressure produced by the rotating impeller. The rotatable shaft is mounted on an adjustable support means which includes bearings or the like (a) on an outside surface of the stationary support means or (b) threaded hollow cylindrical members which fit with threaded bolts. In the first example, a hollow ring-like member having a threaded inside surface is threadably mounted on the threaded portion of the outside surface of the support means for the rotatable shaft. In the second embodiment, threaded bolts are threadably mounted in the threaded hollow cylindrical member and they extend into a threaded portion of a housing section within which the impeller is positioned. In a third embodiment, an acutator is positioned to slideably move the impeller. The rotatable shaft has a free end which is positioned within the stationary housing. The impeller is mounted on the end of the rotatable shaft opposite the free end. The axial position of the impeller within the housing is changed by rotating the hollow ring or bolts relative to the threaded portion or portions of the first surface so as to axially move the impeller relative to an inner surface of a portion of the housing and so that the clearance between the impeller and the inner surface of the housing can be controlled to maximize the efficiency of the impeller. This axial movement is effected without removing the impeller from the housing. The rotatable ring is positioned within the housing and access to the rotatable ring can be effected by removing a housing (can) which houses magnets mounted on the rotatable shaft to expose the rotatable ring. When the rotatable ring or bolts are exposed, an apparatus such as a wrench or like means can be extended through the housing to apply force to the ring or bolt to rotate it. After the impeller has been set to the desired axial position, the hollow ring or bolts are rendered stationary by any suitable means such as a set screw, clamp bolt on the like. Alternatively, the position of the impeller can be effected prior to inserting the impeller and shaft into the pump or compressor apparatus.

The end of the housing which houses the free end of the rotatable shaft is referred to herein as the "wear end" while the portion of the housing which houses the impeller is referred herein as the "pump end". An interior seal can be provided between the wear end and the pump end to prevent fluid being pumped in the pump end from entering the wear end. In addition, fluid means can be fed to the wear end which is passed through the interior seal between the pump end and the wear end to prevent fluid being pumped from entering the wear end during rotation of the impeller. The fluid fed to the wear end can be either a liquid or a gas. Alternatively, when pumping a clean, i.e. noncorrosive fluid, the seal can be eliminated so that fluid being pumped can enter the wear end in order to cool and flush bearings and other apparatus within the wear end to prevent internal damage due to overheating.

In another embodiment of this invention, a module including the rotatable shaft, impeller and support means for the rotatable shaft can be structured so that it is separable from the housing end and is removable therefrom as a unit. When the performance of the impeller is undesirable, it, together with the shaft and support means for the shaft can be removed from the housing and replaced by an identical modular unit which also has a hollow ring or bolts suitable for adjusting the axial position of the impeller. By structuring the shaft and impeller together with support means for the shaft so that it is modular, the entire pump need not be replaced and major portions of the housing for the pump and rotatable means such as magnets from the pump can be reused with a new module. In addition, all of the normal maintenance items of a pump can be replaced as a single unit thereby substantially reducing labor costs. This provides the user with significant cost savings over time.

In accordance with another embodiment of this invention, the modular containment apparatus for adjusting axial positioning of an impeller of this invention is utilized in conjunction with an internal pump positioned between the pump end and the wear end of a pump. The wear end includes a rotor means including a rotatable shaft and a stator wherein the rotor means and the stator are sealed from each by a can structure. The can structure is sealed to a stationary portion of the housing for the pump. The pump end includes pumping means such as an impeller mounted on the rotatable shaft. The internal pump directs small quantities of either a liquid or a pressurized or non-pressurized gas from the wear end to the pump end while preventing the passage of liquid from the pump end into the wear end. When idle, the internal pump device prevents flow from the pump end into the wear end by forming a seal. Thus, the internal pump eliminates the problems associated with non-lubricating fluids, dry running and the pumping of heated, slurried or corrosive liquids with sealless pumps. These pumps differ from prior art sealless pumps which do not include a sealing means or a pump means between the wear end and pump end except for those disclosed in U.S. Pat. Nos. b 5,288,213and 5,308,229 which are incorporated here in by reference. In addition, the embodiment which introduces pressurized or non-pressurized gas from the wear end of the pump end differ form prior art sealless pumps in that liquid is excluded from the wear end. Furthermore, the pump of this invention differs from prior art pumps by utilizing a replaceable module that eliminates the need for replacing the entire pump when only a portion of the pump is worn. One embodiment of the pumps of this invention differ from the prior art pumps by utilizing the modular concept.

DESCRIPTION OF SPECIFIC EMBODIMENTS

Figure 1:
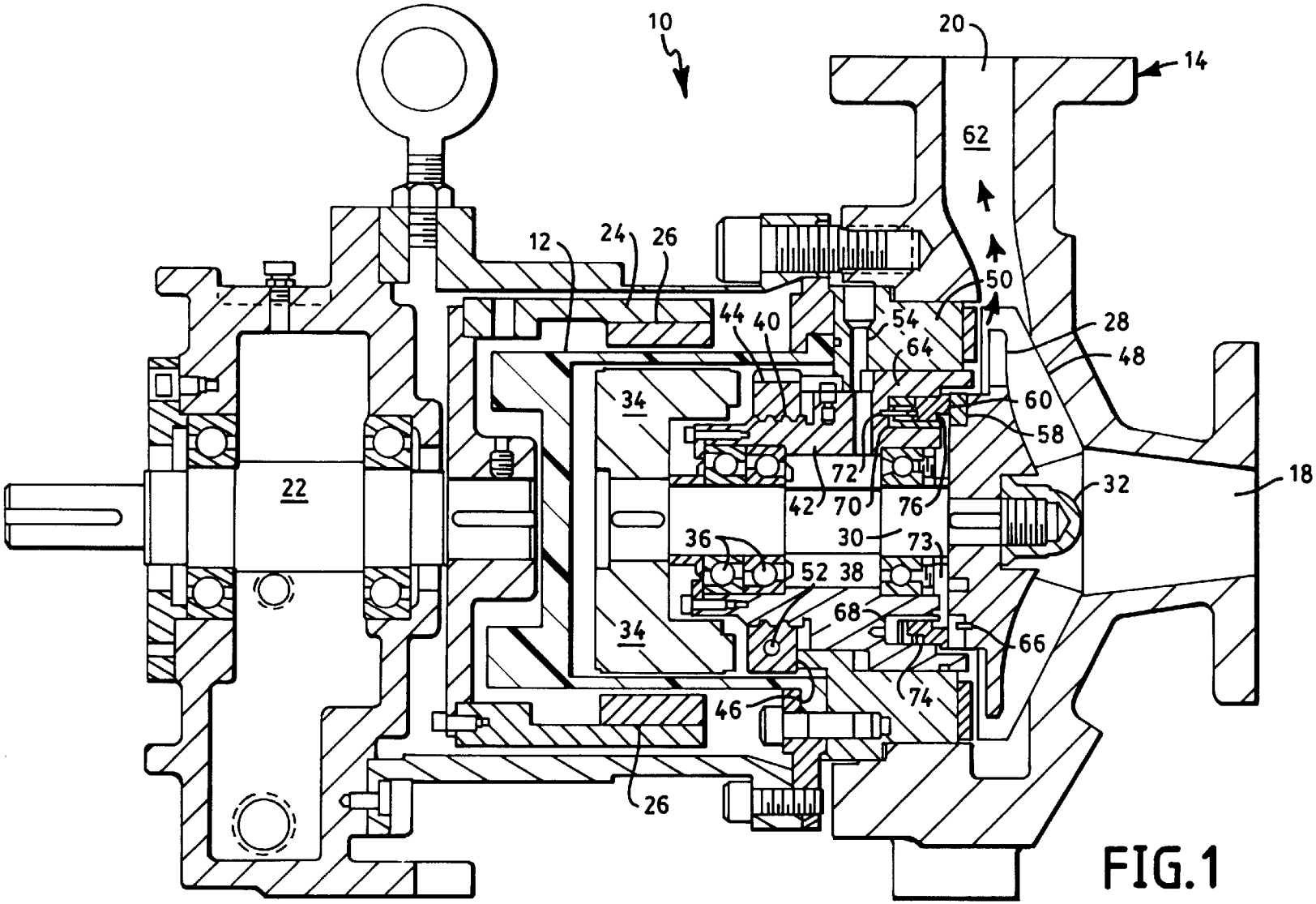
FIG. 1 is a cross-sectional view of the modular apparatus of this invention positioned within a pump.

In accordance with this invention, a pump or compressor is provided which includes an adjusting apparatus for adjusting the axial position of an impeller of the pump or compressor. As used herein, the term "pump" is intended to also include a pump or compressor utilizing an impeller. The adjusting apparatus can be made to be modular so that it can be removed from the pump when worn and replaced with a new identical modular adjusting apparatus. The modular portion of the apparatus of this invention includes the impeller, a shaft for the impeller, driving means for the shaft such as magnets or windings or the like positioned within a containment structure such as a can and means to rotatably support the shaft. The modular containment apparatus is axially moveable relative to the can so that the length of the space between the impeller and a housing for the impeller is adjustable. The modular containment apparatus is provided with suitable seals and bearings as is well known of the art.

The modular containment apparatus can include an internal pump or liquid barrier seal or gas, e.g. air barrier seal which functions to pump pressurized gas or liquid from the wear end to the pump end when the impeller and shaft are rotated. When the impeller and shaft are stationary, the barrier seal or internal pump prevents liquid being pumped from entering the wear end. The modular containment apparatus is axially moveable by means of a threaded bolt or hollow ring (lock nut) having a threaded surface which cooperates with a threaded surface in the modular containment apparatus. Alternatively, the modular containment apparatus can be moved with bolts which extend through a threaded hole of the modular containment apparatus and into a threaded portion of a stationary portion of a housing apparatus for the modular containment apparatus. When either the bolts or the threaded hollow ring are rotated, the modular containment apparatus is moved axially relative to the bolts or ring in a direction which axially extends along the center line of the shaft. When utilized, an internal or barrier seal, which is described in detail below comprises a portion of the containment apparatus. When any portion of the modular containment apparatus is damaged because of the excessive wear or the like, it can be removed from the remaining portion of the pump and repaired or replaced with a new modular containment apparatus or repaired. Thus, the modular containment apparatus provides a means for economically replacing a pump since the outer housing and the pump driving means need not be replaced.

A suitable internal pump comprises a stationary ring mounted on a stationary section of a housing for the pump. The stationary ring is positioned to surround the rotatable shaft in the pump end. A rotatable ring having a face which provides pumping and sealing is mounted on the rotatable shaft between the pump end and the wear end. The rotating ring can be mounted directly on the shaft or indirectly on the shaft by being mounted on an impeller or on a second rotatable ring or the like which, in turn, is mounted on the shaft. The surface of the rotatable ring having the pattern contacts the face of the stationary ring. A pattern or an incline surface on either of the rotatable or the stationary ring provides fluid communication between the wear end and the pump end when the rotatable shaft is rotated and is configured to increase the pressure of lubricating gas or a lubricating liquid in the wear end and to effect passage of small quantities of gas or lubricating liquid from the wear end into the pump end. Since lubricating gas or liquid is pumped into the pump end, passage of liquid from the pump end into wear end is prevented. When the rotatable shaft is stationary, the stationary ring and the rotatable ring contact each other to form a seal which prevents liquid flow from the pump end into the wear end when the lubricating fluid for the internal pump comprises a lubricating gas, antifriction bearings e.g. roller bearings or ball bearings or the like can be utilized in the wear end. In one embodiment, the internal pump can include a spring means for biasing the stationary ring into contact with the rotating ring and can include sealing means comprising a U-shaped housing position ed about the stationary ring. At least one O-ring is positioned in a space between the housing and the spring. A push plate is providing in contact with the spring to bias the spring to effect sealing between the space and the spring.

Referring to FIG. 1 the pump 10 includes a stationary housing formed from a wear end housing section 12 and a pump end housing section 14. The pump 10 includes a liquid inlet 18 and liquid outlet 20 which is in fluid communication with liquid inlet 18. A drive shaft 22 is secured to rotatable housing 24 to which are secured a plurality of magnets 26. A modular containment apparatus of this invention includes the impeller 28, pump shaft 30 to which is secured impeller 28 by means of nut 32, inner magnets 34, and bearings 36 and 38. The modular containment apparatus also includes a threaded surface 40 which extends around the circumference of inner housing section 42. A hollow ring 44 which has an inner threaded surface is positioned on threaded surface 40. Hollow ring 44 bears against stationary annular housing section 46 so that when hollow ring 44 is rotated counter clockwise, the modular containment apparatus extending from the inner magnets 34 to the lock nut 32 moves toward the housing section 14. When the hollow ring 44 is rotated clockwise, the modular containment apparatus is moved rearwardly toward housing section 12 (can). The axial positioning of the modular containment apparatus shown in FIG. 1 relative to housing section 14 in order to adjust the length of the space 48 between the impeller 28 and the housing section 14 is effected prior to positioning the housing section 12 (can) in sealing relationship within housing section 50. The hollow ring 44 is provided with a cap screw 52 or the like which locks the hollow ring 44 into a stationary position after the axial positioning of the modular containment apparatus has been effected satisfactorily.

During the assembly process, hollow ring (locknut) 44 is positioned so that impeller 28 touches casing 14 when the inner magnet 34 is rotated slowly by hand. Hollow ring 44 is rotated clockwise until there is no longer any contact between impeller 28 and casing (14). Since the "lead" of the hollow ring 44 is known, to increase the clearance 48, the hollow ring 44 is rotated clockwise a fraction of one turn until the desired clearance is attained, for example about 40 to 80 degrees.

The embodiment shown in FIG. 1 is provided with an internal pump and means to introduce pressurized or non-pressurized gas into the wear end which is described in U.S. Pat. No. 5,308,229 and which is incorporated herein by reference. These elements are not essential to the present invention but can be utilized with the present invention to form a preferred embodiment of this invention. It is to be understood that the modular containment apparatus described above can be utilized in any pump or compressor which utilizes internal magnets remote from external magnets or windings and which are separated by a stationary sealed housing structure (can) including such pumps wherein fluid being pumped passes into contact with internal magnets 34. In addition, the modular containment apparatus can be utilized in conjunction with an internal pump and means for introducing a liquid into the wear end which is different from the fluid being pumped into the pump end such is described in U.S. Pat. No. 5,288,213 which is incorporated herein by reference.

Can 12 can be formed by a nonmetallic material so is to prevent eddy currents from being generated during use, thereby reducing power requirements and reducing generated heat. Pressurized gas enters through inlet 54 and pressurizes all areas internal to housing section 12 and housing section 50. The gas assists seals comprising rotatable ring 58 and stationary ring 60 to separate from each other so as to pump gas into upstream zone 62. This effects cooling and lubrication of the faces of rotatable ring 58 and stationary ring 60 and prevents liquid being pumped by the impeller 28 from entering the wear end within can 12. The gas also cools bearings such as antifriction bearings 36 and 38. Gas pressurized externally from the pump 10 also can be employed. Also, if desired, sleeve bearings can be utilized rather than antifriction bearings.

The internal pump is formed of the stationary ring 60 and the rotatable ring 58. Stationary ring 60 is secured to housing section 64 which forms part of the modular containment apparatus describes above. Rotatable ring 58 is fixed to the rotatable impeller 28, for example by one or more posts 66 and is position in contact with stationary ring 60. The stationary ring 60 includes a U-shaped housing 68 which houses a spring 70, suitably mounted, such as on a pin and a spring plate 72. Spring 70 and O-ring 74 are positioned within a space between the U-shaped housing 68 and are positioned tightly about stationary seal 60. An optional snap ring 76 assists retaining stationary ring 60, O-ring 74 and spring 70 in housing 68. Further details of this preferred form of the internal seal are disclosed in copending U.S. patent application Ser. No. 08/349,940 filed Dec. 6, 1994 which is incorporated herein by reference. Other conventional forms of an internal pump or seal utilizing a stationary ring in contact with a rotating ring also can be utilized in the present invention. The rotatable ring 58 can be mounted on other rotatable elements of the pump rather than the impeller such as the rotatable shaft 30. During rotation, lubricating gas passes from zone 73 into zone 62. When the ring 58 is stationary, the rings 58 and 60 contact each other to form a seal.

Figure 1A:
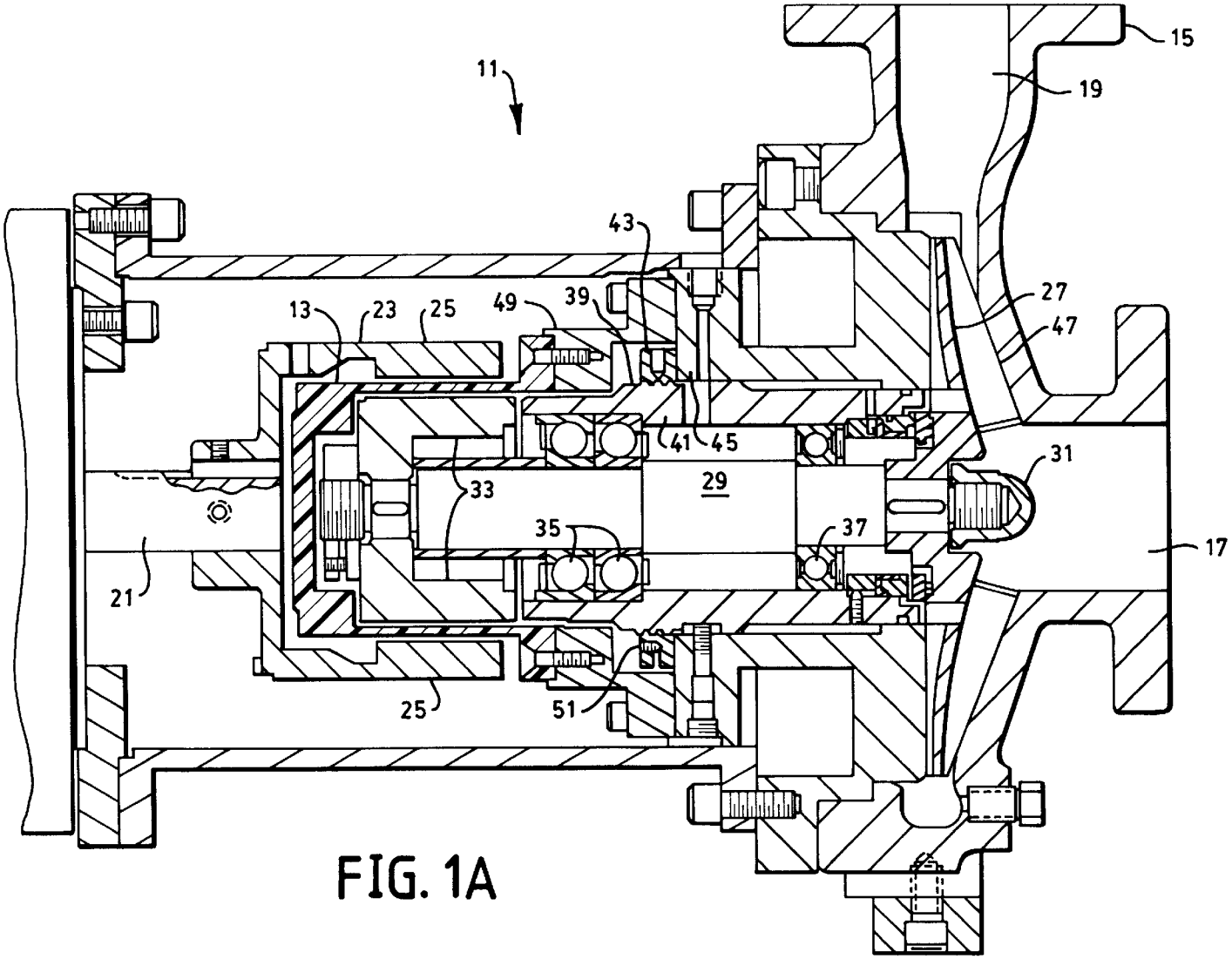
FIG. 1A is cross-sectional view of an alternative modular form of the apparatus of this invention.
Figure 1B:
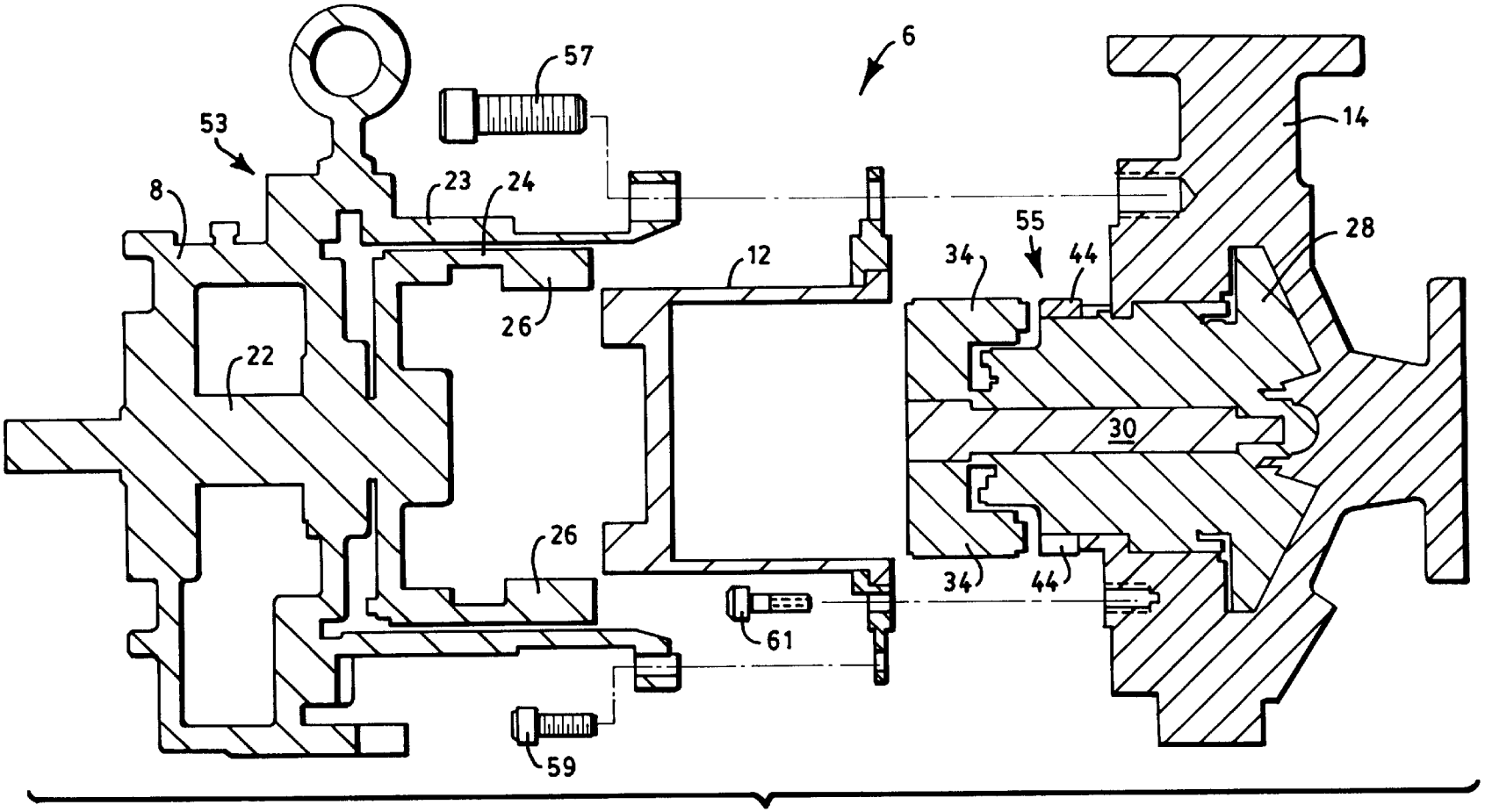
FIG. 1B is an exploded schematic view of the apparatus of FIG. 1 illustrating the modular apparatus of this invention.

The modular apparatus of this invention is illustrated in FIG. 1B which delineates the pump elements shown in FIG. 1. The drive shaft 22 for the rotatable housing 24 in a housing 23 comprise a separable element 53. Can 12 can comprise a separable element. Magnets 34, pump shaft 30, hollow ring 44 and impeller 28 together with supporting apparatus application comprise a separable element 55. Housing section 14 comprises a separable element. The separable elements 53, 12, 55 and 14 are joined together by bolts 57, 59 and 61. When a portion of the separable element 55 becomes damaged, it can removed from the other elements and repaired or replaced while retaining elements 53, 12 and 14 are available for further use thereby providing substantial economic benefit is compared to replacing the entire pumps.

Figure 3:
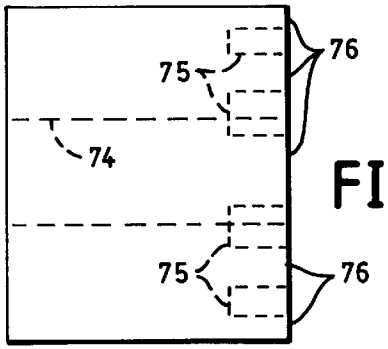
FIG. 3 is a side view of the internal pump of FIG. 2.
Figure 2:
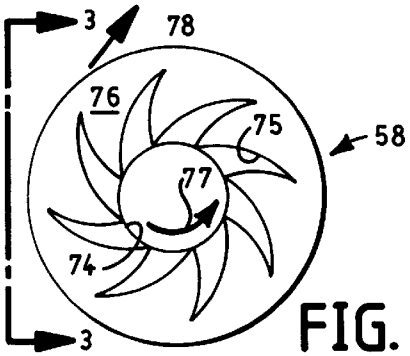
FIG. 2 is a front view of an internal pump utilized with the apparatus shown in FIGS. 1 and 1A.

As shown in FIGS. 2 and 3, in one embodiment, rotatable ring 58 includes slots 75 and surface 76. The surface 76 contacts stationary ring 60. Ring 58 is rotated in the direction of arrow 77 in order to pump gas through the slot 75 in the direction of arrow 78. The slots 75 typically have a depth of about 0.0001 to 0.0003 inch which permits pumping of only small amount of lubricating gas from zone 73 into zone 62 and through outlet 20. It is to be understood that this internal pump can be utilized with any rotatable sealless pump.

Referring to FIG. 1 B, the drive shaft 22 and rotatable housing 24 are positioned within housing section 8. Wear end housing section (can) 12 is shown separated from rotatable housing 24 and housing section 8. The modular apparatus of this invention 6 includes inner magnets 34, rotatable pump shaft 30, impeller 28 and support means for the shaft 30 including bearing 36 and 38 (see FIG. 1). The modular apparatus 6 can be replaced as a unit when needed without discarding the remainder of the pump 10. In addition, if desired magnets 34 can be recovered from the modular apparatus 6 for reuse. Thus, the modular apparatus 6 permits significant economies for the user.

Figure 11:
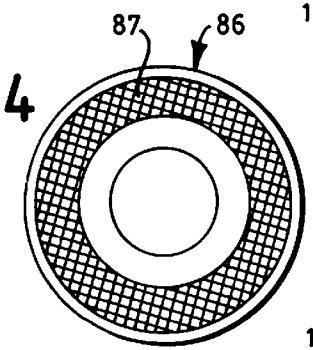
FIG. 11 is a front view of an alternative rotatable ring of an internal pump useful in this invention.
Figure 4:
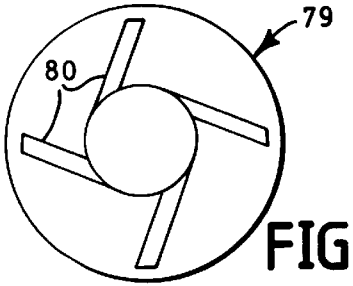
FIG. 4 is a front view of an alternative rotatable ring of an internal pump useful in the present invention.
Figure 6:
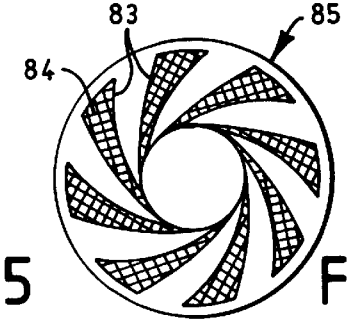
FIG. 6 is a front view of an alternative rotatable ring of an internal pump useful in this invention.
Figure 12:
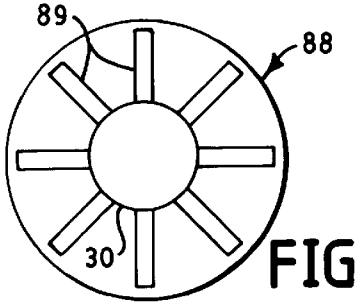
FIG. 12 is a front view of an alternative rotatable ring of an internal pump useful in this invention.
Figure 5:
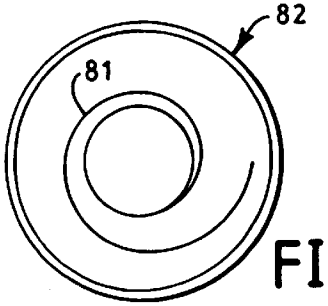

Referring to FIGS. 4–6, 11 and 12, alternative rotatable rings are shown which contact the stationary ring having a flat surface and function as described above with reference to FIGS. 2 and 3. As shown in FIG. 4, the rotatable ring 79 includes a plurality of angled slots 80. As shown in FIG. 5, a spiral shaped slot 81 is utilized on the rotatable ring 82. As shown in FIG. 6, sail-shaped slots 83 having plurality of pockets 84 are utilized on rotatable ring 85. As shown in FIG. 11, the rotatable ring 86 includes a ring shaped indentation 87. As shown in FIG. 12, a rotatable ring 88 can be positioned on shaft 30. A plurality of slots 89 extend from the shaft 30.

Figure 7:
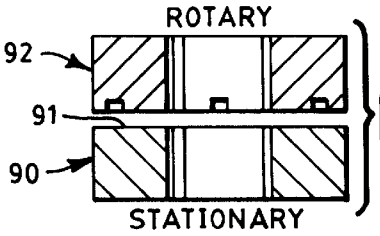
FIG. 7 is a side view of an alternative rotatable ring of an internal pump useful in this invention.
Figure 8:
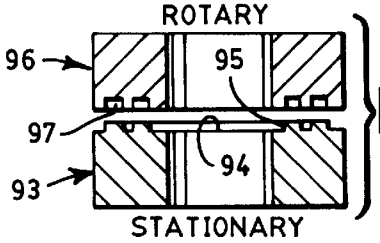
FIG. 8 is a side view of an alternative rotatable ring of an internal pump useful in this invention.
Figure 9:
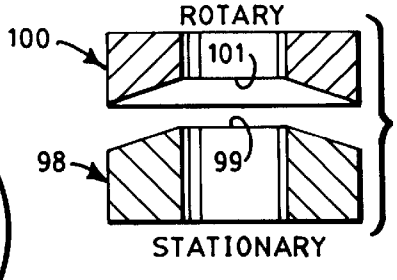
FIG. 9 is a side view of an alternative rotatable ring of an internal pump useful in this invention.
Figure 10:
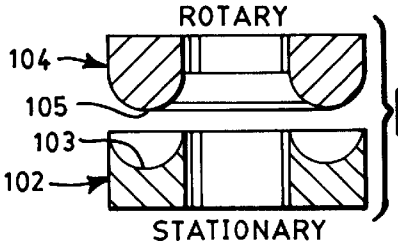
FIG. 10 is a side view of an alternative rotatable ring of an internal pump useful in this invention.

Referring to FIGS. 7–10, arrangements of a rotatable ring and a stationary ring are shown wherein the stationary ring has non flat or flat surface. As shown in FIG. 7, the stationary ring 90 has a flat surface 91 and rotatable ring 92 has indentations as shown in FIGS. 2 and 4. As shown in FIG. 8, stationary ring 93 has a surface 94 with a labyrinth 95 while rotatable ring 96 has a mating labyrinth 97. As shown in FIG. 9, stationary ring 98 has a raised central surface 99 while rotatable ring 100 has a mating indented surface 101. As shown in FIG. 10 stationary ring 102 has a surface with a circular indentation 103 while rotatable ring 104 has a mating surface 105. Other suitable arrangements of a rotatable ring and a stationary are disclosed in U.S. Pat. Nos. 4,290,611 and 5,090,712 which are incorporated herein by reference.

Referring to FIG. 1A, the pump 11 includes a stationary housing formed from a wear end housing section 13 and a pump end housing section 15. The pump 11 includes a liquid inlet 17 and liquid outlet 19 which is in fluid communication with liquid inlet 17. A drive shaft 21 is secured to rotatable housing 23 to which are secured a plurality of magnets 25. A modular containment apparatus of this invention includes the impeller 27, pump shaft 29 to which is secured impeller 27 by means of nut 31, inner magnets 33, and bearings 35 and 37. The modular containment apparatus also includes a threaded surface 39 which extends around the circumference of inner housing section 41. A hollow ring 43 which has an inner threaded surface is positioned on threaded surface 39 outside of wear end housing section 13. Hollow ring 43 bears against stationary annular housing section 45 so that when hollow ring 43 is rotated counter-clockwise, the modular containment apparatus extending from the inner magnets 33 to the lock nut 31 moves toward the housing section 15. When the hollow ring 43 is rotated clockwise, the modular containment apparatus is moved rearwardly toward housing section 13 (can). The axial positioning of the modular containment apparatus shown in FIG. 1A relative to housing section 15 in order to adjust the length of the space 47 between the impeller 27 and the housing section 15 is effected subsequent to positioning the housing section 13 (can) in sealing relationship within housing section 49. The hollow ring 43 is provided with a set screw 51 which locks the hollow ring 43 into a stationary position after the axial positioning of the modular containment apparatus has been effected satisfactorily.

Figure 13:
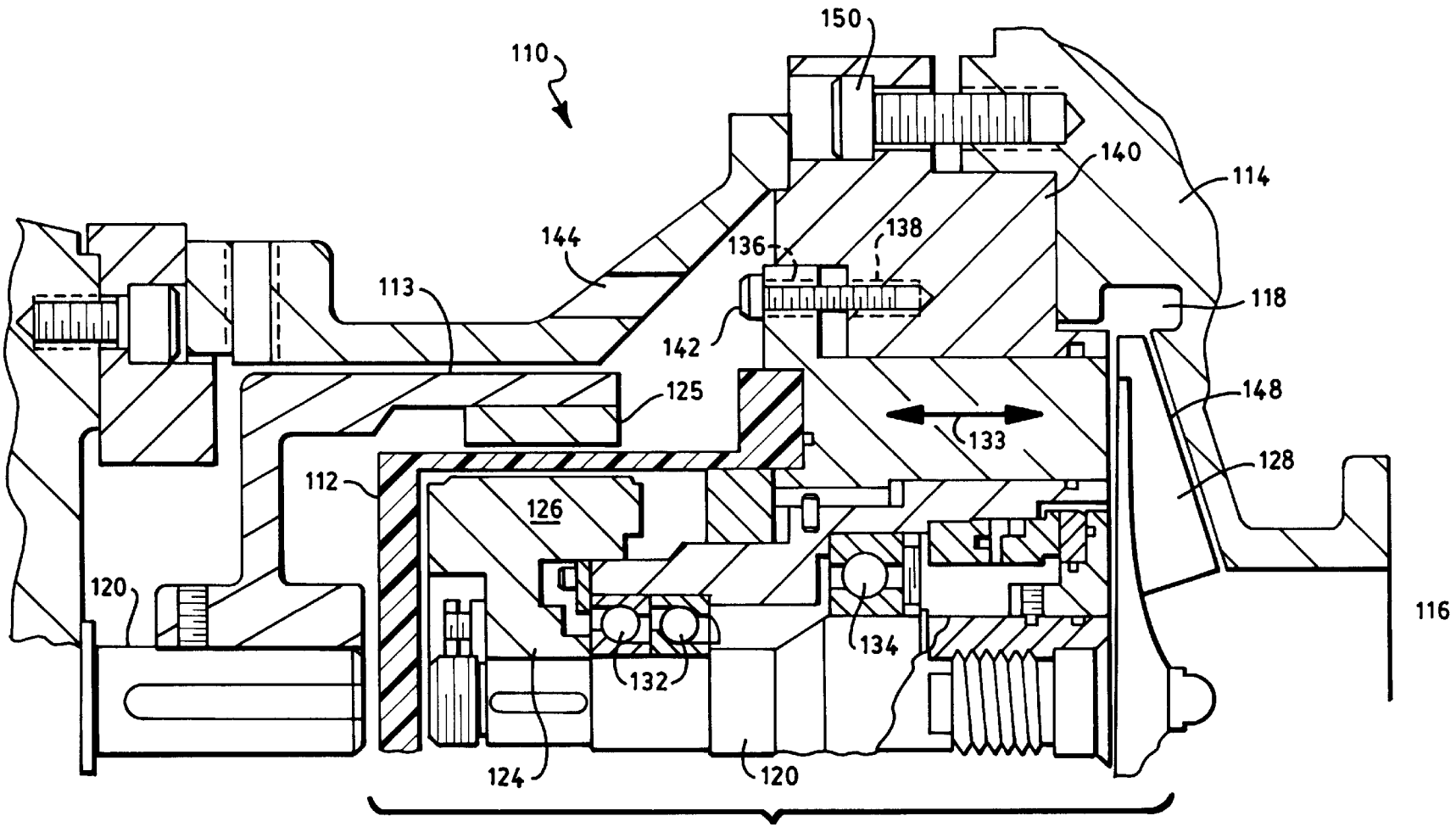
FIG. 13 is a partial cross sectional view of the module-containing apparatus of this invention utilizing bolts illustrated in FIG. 13A to adjust axial position of an impeller.

Referring to FIG. 13, the pump 110 includes a stationary housing formed from a wear end housing section 112 and a pump end housing section 114. The pump 110 includes a liquid inlet 116 and a liquid outlet 118 which is in fluid communication with liquid inlet 116. Drive shaft 120 is secured to rotatable housing 113 to which are secured a plurality of magnets 125. A modular containment apparatus 127 of this invention includes the impeller 128, pump shaft 120 to which is secured impeller 128 inner magnets 126 and bearings 132 and 134. The modular containment apparatus, adapted to move axially as indicated by arrows 133. For convenience, FIG. 13 shows only one bolt 142. In actuality, axial adjustment of the modular containment apparatus is effected with two or more, usually 6 to 8 sets of 2 bolts in each set (See FIG. 14) wherein one bolt functions as a "pull" bolt and the second bolt of each set functions as a "push" bolt. Access to bolt 142 can be had through hole 144 which can be subsequently sealed in any conventional manner such as with a plug. The axial positioning of the modular containment apparatus shown in FIG. 13 relative to housing section 114, in order to adjust the length of the space 148 between impeller 128 and the housing section 114, is effected subsequent to positioning the housing section 112 (can) in sealing relationship with housing section 140 and prior to bolt 150.

Figure 14:
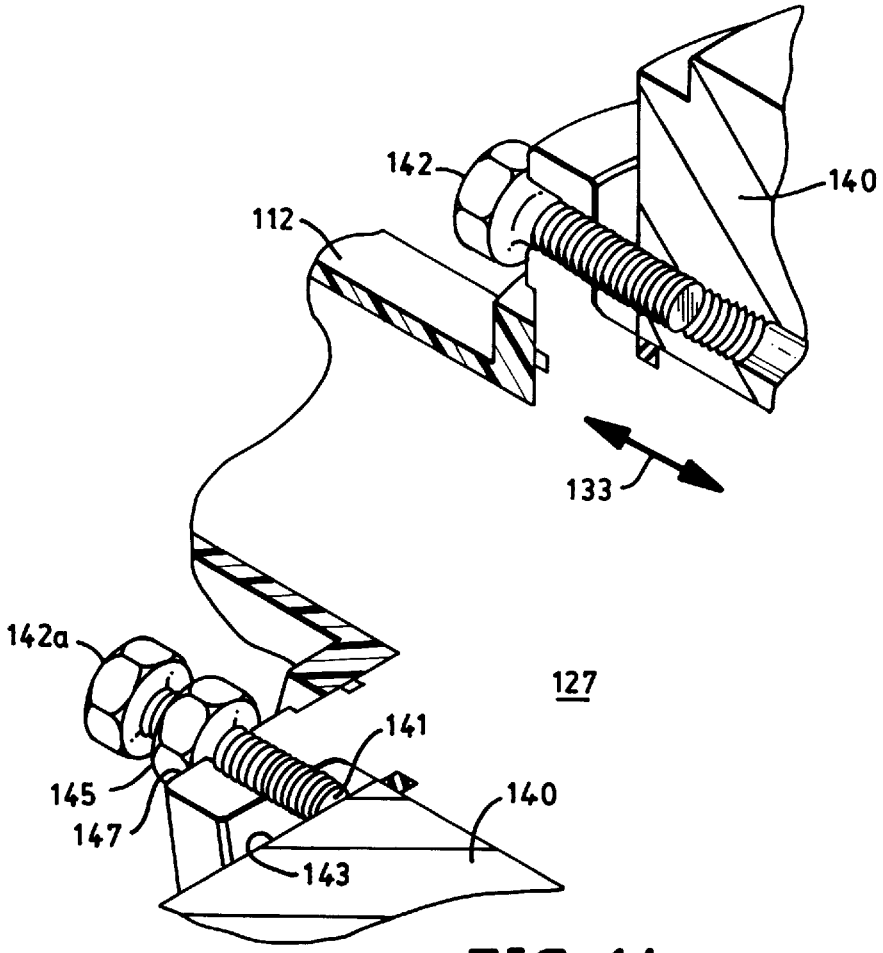
FIG. 14 is a close-up schematic view of a system of bolts utilized to position the modular containment apparatus shown in FIG. 13.

Referring to FIG. 14, a set of bolts, one comprising a "pull" bolt 142 and one comprising a "push" bolt 142*a* is shown. As set forth above, usually 6 to 8 sets of the two bolts are utilized in the apparatus of this invention. To increase clearance 148 (FIG. 13) bolt 142 is loosened by turning it counter clockwise and bolt 142*a* is turned clockwise. When the desired clearance 148 is attained, bolt 142 is turned clockwise so that end bolt surface 141 is clamped to surface 143 of housing section 140. Nut 145 then is turned clockwise until it contacts surface 147. By operating in this manner, module 127 is locked in place and clearance 148 is maintained.

Figure 15:
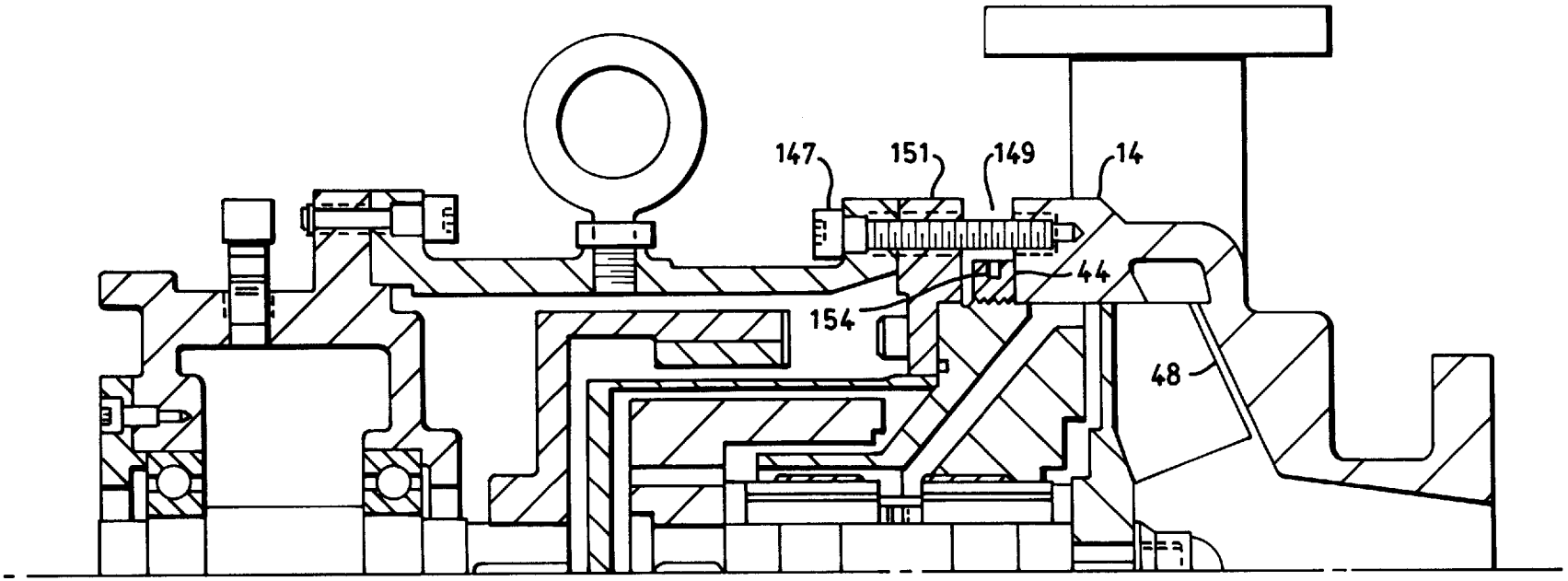
FIG. 15 is a partial cross-sectional view illustrating the use of the present invention.

Referring to FIG. 15, a second embodiment for adjusting the clearance 48 with a hollow ring 44 from a location external the pump is shown. A plurality of clamp bolts 147 (one shown) are loosened to form a space 149 between housing section 14 and housing section 151. A wrench is inserted into space 149 into hole 154 in order to rotate hollow ring 44 in the manner described above.

Figure 16:
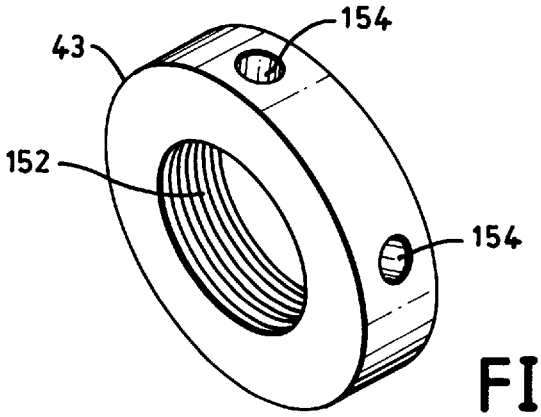
FIG. 16 is an isometric view of a lock nut useful in the present invention.

Referring to FIG. 16, the hollow ring 43 includes a threaded inner surface 152 and one or a plurality of holes 154 into which can be inserted a wrench in order to apply a rotating force to the hollow ring 43. The threaded surface 152 mates with threaded surface 39 (FIG. 1*a*) or 40 (FIG. 1).

Figure 17:
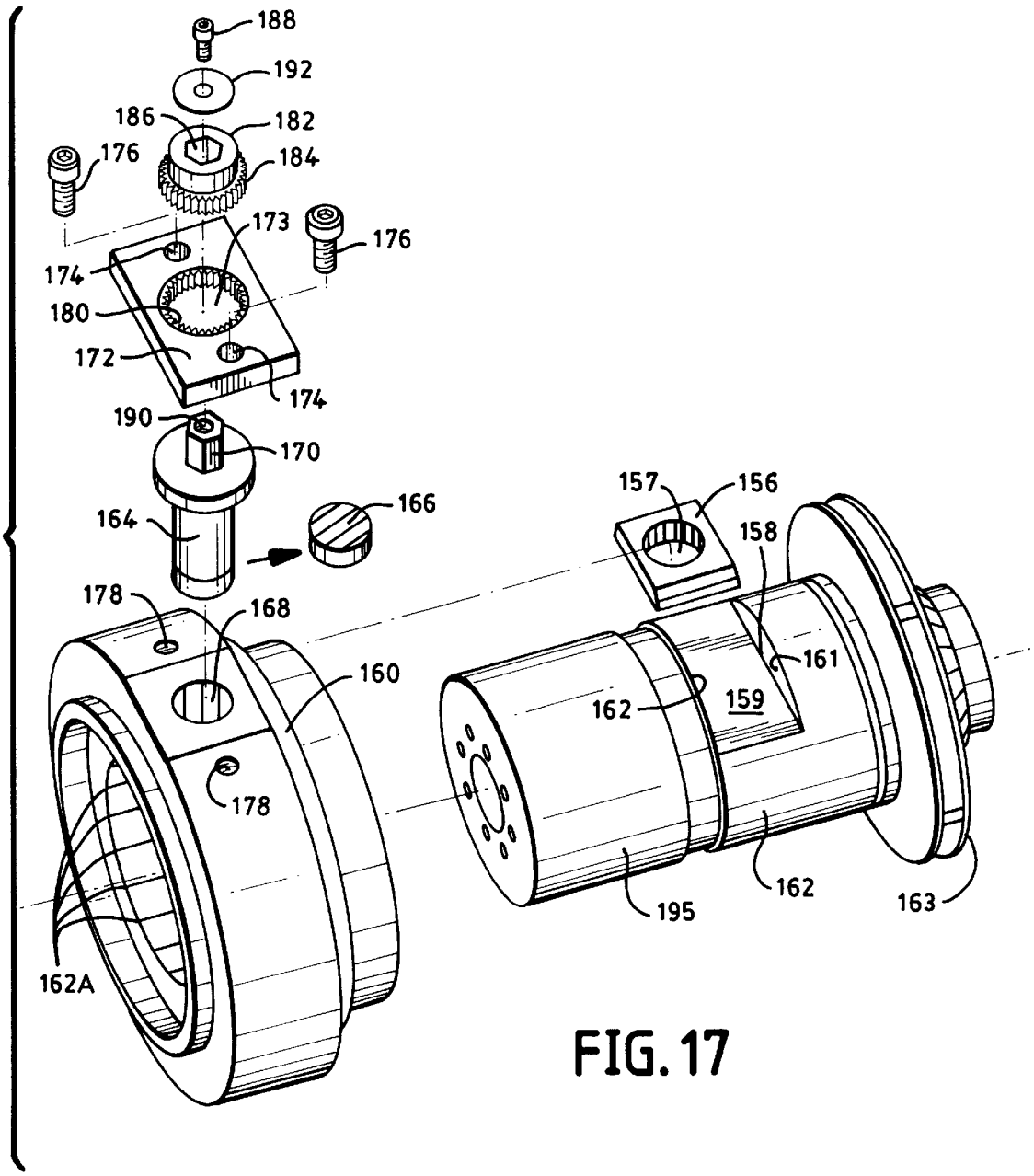
FIG. 17 is an exploded view of an adjustment means external a pump for rotating a lock nut.

Referring to FIG. 17, relatively thick washer 156 having a hole 157 there through is positioned within slot 158 having a flat surface 159. Washer 156 is shaped to permit it to slide within slot 158 and to bear against side surfaces 161 and 162 in order to move module 162A including impeller 163 axially. A stem actuator 164 having an eccentric, e.g. elliptical, cross-section 166 is positioned through hole 168 of housing 160 to extend into hole 157 of washer 156. Actuator 164 has a hexagonal nut 170 or the like which can be grasped with a tool such as a wrench (not shown) to effect rotation of the eccentric actuator 164. A clamp 172 having holes 174 can be secured to housing 160 by threaded bolts 176 which can be screwed into threaded holes 178 of housing 160. The clamp 172 can include a hole 173 having peripherally positioned teeth 180 into which is fit on actuator lock 182 having teeth 184 which mate with teeth 180. The actuator lock 182 can have a central hole 186 that fits over nut 170. A bolt 188 can be supplied to threadably fit into threaded hold 190 to provide a means for locking the actuator 164 in place in the washer 186.

Figure 18:
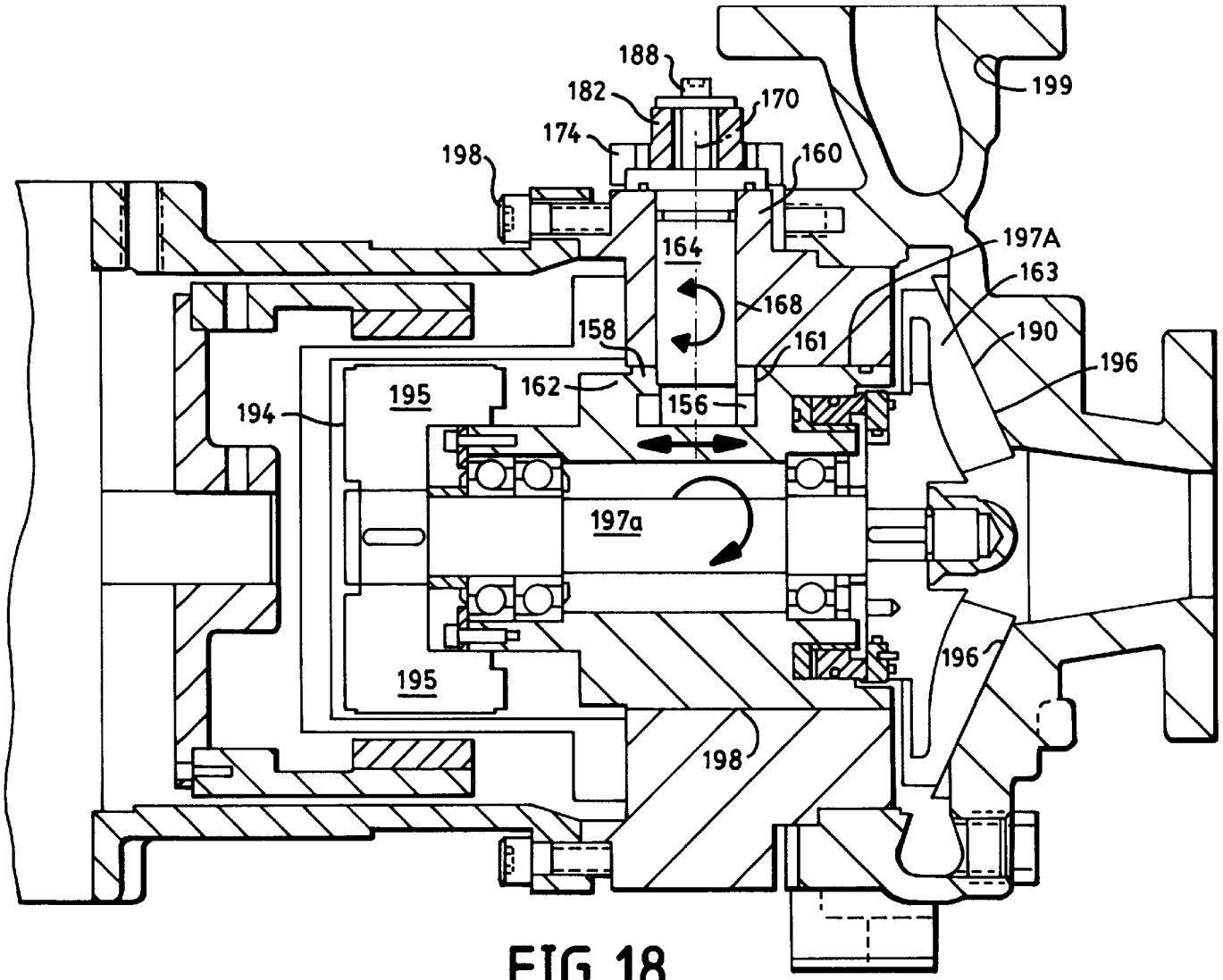
FIG. 18 is an cross-sectional view of the adjustment means position ed in a pump.

The operation of the actuator structure of FIG. 17 will be described with reference to FIGS. 17 and 18. In order to adjust the distance between impeller 163 and housing 191, the actuator lock bolt 188, washer 192 and actuator lock 182 are removed from the position shown. The clamp bolts 176 are loosened and the actuator 164 is rotated counter clockwise to reduce distance 190 or clockwise to increase distance 190. The actuator clamp then is secured by bolt 176 and the actuator lock 182 is installed and secured with washer 192 and bolt 188.

In order to repair or remove the module extending from the rear surface 194 of magnet 195 to the front surface 196 of impeller 163 and from top surface 197A to bottom surface 198 of housing 162 including rotating shaft 197A, the actuator clamp bolt 176, actuator clamp 172 and actuator 164 are removed from position. The clamp bolt 198 then is removed. Housing section 199 is removed. The module then is removed from within housing 160. The portion of the pump remaining after the module is removed can be reused including housing section 199.

I claim:

1. Apparatus for moving a fluid under pressure which comprises a stationary housing having a housing section, an impeller positioned within said housing and adjacent said housing section to define a space between said impeller and an inner surface of said ho using section, said impeller being mounted on a rotatable shaft having a free end positioned within said housing and having a major axis extending through the center of and along the length of the rotatable shaft, means for supporting said shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated.

2. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center and along the length of the rotatable shaft, sa id rotatable shaft being mounted in a wear end of said pump, said wear end including a rotor, means for effecting rotation of said rotor and said shaft, a stationary housing seal between said means for effecting rotation and said rotor, means for introducing a fluid into said pump end, means for removing said fluid from said pump end, means for introducing gas into said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects transfer of said gas in said wear end to said pump end while preventing said liquid in said pump end from entering said wear end when said shaft is rotated and said internal pump sealing said wear end from said pump end when said shaft is not rotated, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated.

3. The pump of claim 2 wherein said first face includes an inclined surface.

4. The pump of claim 2 wherein said first face includes indentations.

5. The pump of any one of claims 1 or 2 wherein said means for effecting rotation of said rotor and said shaft comprises windings.

6. The pump any one of claims 1 or 2 wherein said rotor comprises rotatable magnet means.

7. The pump any one of claims 1 or 2 wherein said means for effecting rotation of said rotor and said shaft comprises rotating magnet means.

8. The pump any one of claims 1 or 2 wherein said rotor comprises a rotatable torque ring.

9. The pump of any one of claim 2 wherein said gas is air.

10. The pump of any one of claims 1 or 2 which includes means for passing a heat exchange fluid through a stationary housing for said pump.

11. The pump of any one of claims 1 or 2 wherein said rotatable ring is connected directly on said shaft.

12. The pump of any one of claims 1 or 2 wherein said rotatable ring is connected on rotatable mounting means, said rotatable mounting means being mounted on said shaft.

13. The pump of any one of claims 1 or 2 wherein said gas is nitrogen.

14. The pump of any one of claims 1 or 2 wherein said rotatable shaft in said wear end is mounted on antifriction bearing means.

15. The pump of any one of claims 1 or 2 wherein said rotatable member is a hollow ring having an inner surface which is threaded.

16. The pump of any one of claims 1 or 2 wherein said rotatable member is at least one set or two threaded bolts.

17. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center of and along the length of the rotatable shaft, said rotatable shaft being mounted in a wear end of said pump, said wear end including a rotor, means for effecting rotation of said rotor and said shaft and a stationary housing seal between said means for effecting rotation and said rotor, means for introducing a first liquid into said pump end, means for removing said first liquid from said pump end, means for introducing a second liquid into said wear end, means for removing said second liquid from said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects pumping of said second liquid in said wear end to said pump end while preventing said first liquid in said pump end from entering said wear end when said shaft is rotated, said internal pump sealing said pump end from said wear end when said shaft is not rotated, means for cooling said wear end, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated.

18. A pump for moving a fluid under pressure which comprises a housing having a housing section, an impeller positioned within a pump end of said housing and adjacent said housing section to define a space between said impeller and an inner surface in said pump end of said housing section, said impeller being mounted on a rotatable shaft having a major axis extending through the center of and along the length of the rotatable shaft, said rotatable shaft being mounted in a wear end of said pump, said wear end including a rotor, means for effecting rotation of said rotor and said shaft, means for circulating fluid from said pump end, through said wear end and back to said pump end, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and housing being structured to permit fluid to pass through said space when said impeller is rotated.

19. The pump of any one of claims 1, 2, or 18 wherein said means for supporting said shaft, said shaft and said impeller are separable from said housing and are removable from said housing.

20. The pump of any one of claims 17 or 18 wherein said rotatable member is a hollow ring having an inner surface which is threaded.

21. The pump of any one claims 17 or 18 wherein said rotatable member is at least one set of two threaded bolts.

22. The pump of claim 19 wherein said rotatable member is a hollow ring having an inner threaded surface.

23. The pump of claim 19 wherein said rotatable member is at least one set of two threaded bolts.

24. The pump of any one claim 19 wherein said rotable member is a hollow ring having an inner threaded surface.

25. The pump of claim 19 wherein said rotatable member is threaded bolt.

26. The pump of claim 21 wherein said rotatable member is a hollow ring having an inner threaded surface.

27. Apparatus for moving a fluid under pressure which comprises a stationary housing having a housing section, an impeller positioned within said housing and adjacent said housing section to define a space between said impeller and an inner surface of said housing section, said impeller being mounted on a rotatable shaft having a first free end positioned within said housing and having a major axis extending through the center of and along the length of the rotatable shaft, magnet means mounted in a second free end of said rotatable shaft, means for supporting said shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated and said rotatable shaft, said magnet means, said impeller and apparatus mounted on said shaft positioned between said magnet means and said impeller being removable from said apparatus as a single unit.

28. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center and along the length of the rotatable shaft, magnet means mounted in a second free end of said rotatable shaft, said rotatable shaft being mounted in a wear end of said pump, said wear end including a rotor, means for effecting rotation of said rotor and said shaft, a stationary housing seal between said means for effecting rotation and said rotor, mean for introducing a fluid into said pump end, means for removing said fluid from said pump end, means for introducing gas into said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects transfer of said gas in said wear end to said pump end while preventing said liquid in said pump end from entering said wear end when said shaft is rotated and said internal pump sealing said wear end from said pump end when said shaft is not rotated, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated and said rotatable shaft, said magnet means, said impeller and apparatus mounted on said shaft positioned between said magnet means and said impeller being removable from said apparatus as a single unit.

29. The pump of claim 28 wherein said first face includes an inclined surface.

30. The pump of claim 28 wherein said first face includes indentations.

31. The pump of any one of claims 27 or 28 wherein said means for effecting rotation of said rotor and said shaft comprises windings.

32. The pump of any one of claims 27 or 28 wherein said rotor comprises rotatable magnet means.

33. The pump of any one of claims 27 or 28 wherein said means for effecting rotation of said rotor and said shaft comprises rotating magnet means.

34. The pump of any one of claims 27 or 28 wherein said rotor comprises a rotatable torque ring.

35. The pump of claim 28 wherein said gas is air.

36. The pump of claim 28 which includes means for passing a heat exchange fluid through a stationary housing for said pump.

37. The pump of claim 28 wherein said rotatable ring is connected directly on said shaft.

38. The pump of claim 28 wherein said rotatable ring is connected on rotatable mounting means, said rotatable mounting means being mounted on said shaft.

39. The pump of claim 28 wherein said gas is nitrogen.

40. The pump of claim 28 wherein said rotatable shaft in said wear end is mounted on antifriction bearing means.

41. The pump of claim 28 wherein said rotatable member is a hollow ring having an inner surface which is threaded.

42. The pump of claim 28 wherein said rotatable member is at least one set of two threaded bolts.

43. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center of and along the length of the rotatable shaft, magnet means mounted in a second free end of said rotatable shaft, said rotatable shaft being mounted in a wear end of said pump, said wear end including a rotor, means for effecting rotation of said rotor and said shaft and a stationary housing seal between said means for effecting rotation and said rotor, means for introducing a first liquid into said pump end, means for removing said first liquid from said pump end, means for introducing a second liquid into said wear end, means for removing said second liquid from said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects pumping of said second liquid in said wear end to said pump end while preventing said first liquid in said pump end from entering said wear end when said shaft is rotated, said internal pump sealing said pump end from said wear end when said shaft is not rotated, means for cooling said wear end, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and said housing being structured to permit fluid to pass through said space when said impeller is rotated, and said rotatable shaft, said magnet means, said impeller and apparatus mounted on said shaft positioned between said magnet means and said impeller being removable from said apparatus as a single unit.

44. A pump for moving a fluid under pressure which comprises a housing having a housing section, an impeller positioned within a pump end of said housing and adjacent said housing section to define a space between said impeller and an inner surface in said pump end of said housing section, said impeller being mounted on a rotatable shaft having a major axis extending through the center of and along the length of the rotatable shaft, magnet means mounted in a free end of said rotatable shaft, said rotatable shaft being mounted in a wear end of said pump, said wear end including a rotor, means for effecting rotation of said rotor and said shaft, means for circulating fluid from said pump end, through said wear end and back to said pump end, means for supporting said rotatable shaft having a first surface which remains stationary when said shaft is rotated, a portion of said first surface comprising a first threaded surface, a rotatable member having a second threaded surface that cooperates with said first threaded surface so that when said rotatable member is rotated independently of said first surface, said impeller is moved relative to said housing section axially in a direction defined by said major axis, said impeller and housing being structured to permit fluid to pass through said space when said impeller is rotated and said rotatable shaft, said magnet means, said impeller and apparatus mounted on said shaft positioned between said magnet means and said impeller being removable from said apparatus as a single unit.

45. The pump of any one of claims 43 or 44 wherein said rotatable member is at least one set of two threaded bolts.

46. The pump of any one of claims 43 or 44 wherein said rotatable member is a hollow ring having an inner threaded surface.

47. Apparatus for moving a fluid under pressure which comprises a stationary housing having a housing section, an impeller positioned within said housing and adjacent said housing section to define a space between said impeller and an inner surface of said housing section, said impeller being mounted on a rotatable shaft having a free end positioned within said housing and having a major axis extending through the center of and along the length of the rotatable shaft, means for supporting said shaft having a first surface which remains stationary when said shaft is rotated, a portion of said first surface having a slot, a rotatable member having means for exerting force on walls of said slot to move said impeller relative to said housing section axially in a direction defined by said major axis, said impeller and said housing being structured to permit fluid to pass through said space when said impeller is rotated.

48. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center and along the length of the rotatable shaft, said rotatable shaft being mounted in a wear end of said pump, said wear end including a rotor, means for effecting rotation of said rotor and said shaft, a stationary housing seal between said means for effecting rotation and said rotor, means for introducing a fluid into said pump end, means for removing said fluid from said pump end, means for introducing gas into said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects transfer of said gas in said wear end to said pump end while preventing said liquid in said pump end from entering said wear end when said shaft is rotated and said internal pump sealing said wear end from said pump end when said shaft is not rotated, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and said housing being structured to permit fluid to pass through said space when said impeller is rotated.

49. The pump of claim 48 wherein said first face includes an inclined surface.

50. The pump of claim 48 wherein said first face includes indentations.

51. The pump of any one of claims 47 or 48 wherein said means for effecting rotation of said rotor and said shaft comprises windings.

52. The pump any one of claims 47 or 48 wherein said rotor comprises rotatable magnet means.

53. The pump any one of claims 47 or 48 wherein said means for effecting rotation of said rotor and said shaft comprises rotating magnet means.

54. The pump any one of claims 47 or 48 wherein said rotor comprises a rotatable torque ring.

55. The pump of any one of claims 47 or 48 which includes means for passing a heat exchange fluid through a stationary housing for said pump.

56. The pump of any one of claims 47 or 48 wherein said rotatable ring is connected directly on said shaft.

57. The pump of any one of claims 47 or 48 wherein said rotatable ring is connected on rotatable mounting means, said rotatable mounting means being mounted on said shaft.

58. The pump of any one of claims 47 or 48 wherein said rotatable shaft in said wear end is mounted on antifriction bearing means.

59. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center of and along the length of the rotatable shaft, said rotatable shaft being mounted in a wear end of said pump, said wear end including a rotor, means for effecting rotation of said rotor and said shaft and a stationary housing seal between said means for effecting rotation and said rotor, means for introducing a first liquid into said pump end, means for removing said first liquid from said pump end, means for introducing a second liquid into said wear end, means for removing said second liquid from said wear end, an internal pump positioned between said pump end an said wear end on said rotatable shaft, said internal pump comprising a rotatable ring connected to said shaft and having a first face contacting a second face on a stationary ring, said first face and second face having a surface configuration which effects pumping of said second liquid in said wear end to said pump end while preventing said first liquid in said pump end from entering said wear end when said shaft is rotated, said internal pump sealing said pump end from said wear end when said shaft is not rotated, means for cooling said wear end, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and said housing being structured to permit fluid to pass through said space when said impeller is rotated.

60. A pump for moving a fluid under pressure which comprises a housing having a housing section, an impeller positioned within a pump end of said housing and adjacent said housing section to define a space between said impeller and an inner surface in said pump end of said housing section, said impeller being mounted on a rotatable shaft having a major axis extending through the center of and along the length of the rotatable shaft, said rotatable shaft being mounted in a wear end of said pump, said wear end including a rotor, means for effecting rotation of said rotor and said shaft, means for circulating fluid from said pump end, through said wear end and back to said pump end, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and housing being structured to permit fluid to pass through said space when said impeller is rotated.

61. The pump of any one of claims 47, 48, 59 or 60 wherein said means for supporting said shaft, said shaft and said impeller are separable from said housing and are removable from said housing.

62. Apparatus for moving a fluid under pressure which comprises a stationary housing having a housing section, an impeller positioned within said housing and adjacent said housing section to define a space between said impeller and an inner surface of said housing section, said impeller being mounted on a rotatable shaft having a first free end positioned within said housing and having a major axis extending through the center of and along the length of the rotatable shaft, magnet means mounted in a second free end of said rotatable shaft, means for supporting said shaft having a first surface which remains stationary when said shaft is rotated, a portion of said first surface having a slot, means for exerting force on walls of said slot to move said impeller relative to said housing section axially in a direction defined by said major axis, said impeller and said housing being structured to permit fluid to pass through said space when said impeller is rotated and said rotatable shaft, said magnet means, said impeller and apparatus mounted on said shaft positioned between said magnet means and said impeller being removable from said apparatus as a single unit.

63. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center and along the length of the rotatable shaft, magnet means mounted in a second free end of said rotatable shaft, said rotatable shaft being mounted in a wear end of said pump, said wear end including a rotor, means for effecting rotation of said rotor and said shaft, a stationary housing seal between said means for effecting rotation and said rotor, mean for introducing a fluid into said pump end, means for removing said fluid from said pump end, means for introducing gas into said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects transfer of said gas in said wear end to said pump end while preventing said liquid in said pump end from entering said wear end when said shaft is rotated and said internal pump sealing said wear end from said pump end when said shaft is not rotated, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and said housing being structured to permit fluid to pass through said space when said impeller is rotated and said rotatable shaft, said magnet means, said impeller and apparatus mounted on said shaft positioned between said magnet means and said impeller being removable from said apparatus as a single unit.

64. The pump of claim 63 wherein said first face includes an inclined surface.

65. The pump of claim 63 wherein said first face includes indentations.

66. The pump of any one of claims 27 or 28 wherein said means for effecting rotation of said rotor and said shaft comprises windings.

67. The pump of any one of claims 27 or 28 wherein said rotor comprises rotatable magnet means.

68. The pump of any one of claims 27 or 28 wherein said means for effecting rotation of said rotor and said shaft comprises rotating magnet means.

69. The pump of any one of claims 27 or 28 wherein said rotor comprises a rotatable torque ring.

70. The pump of claim 27 or 28 which includes means for passing a heat exchange fluid through a stationary housing for said pump.

71. The pump of claim 27 or 28 wherein said rotatable ring is connected directly on said shaft.

72. The pump of claim 27 or 28 wherein said rotatable ring is connected on rotatable mounting means, said rotatable mounting means being mounted on said shaft.

73. The pump of claim 27 or 28 wherein said rotatable shaft in said wear end is mounted on antifriction bearing means.

74. A pump for moving a fluid under pressure which comprises a stationary housing having a housing section, an impeller positioned within a pump end of said housing and adjacent said housing section to define a space between said impeller and an inner surface in said pump end of said housing section, said impeller being mounted on a rotatable shaft having a free end positioned within said housing and having a major axis extending through the center of and along the length of the rotatable shaft, magnet means mounted in a free end of said rotatable shaft, said rotatable shaft being mounted in a wear end of said pump, said wear end including a rotor, means for effecting rotation of said rotor and said shaft and a stationary housing seal between said means for effecting rotation and said rotor, means for introducing a first liquid into said pump end, means for removing said first liquid from said pump end, means for introducing a second liquid into said wear end, means for removing said second liquid from said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects pumping of said second liquid in said wear end to said pump end while preventing said first liquid in said pump end from entering said wear end when said shaft is rotated, said internal pump sealing said pump end from said wear end when said shaft is not rotated, means for cooling said wear end, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and said housing being structured to permit fluid to pass through said space when said impeller is rotated, and said rotatable shaft, said magnet means, said impeller and apparatus mounted on said shaft positioned between said magnet means and said impeller being removable from said apparatus as a single unit.

75. A pump for moving a fluid under pressure which comprises a housing having a housing section, an impeller positioned within a pump end of said housing and adjacent said housing section to define a space between said impeller and an inner surface in said pump end of said housing section, said impeller being mounted on a rotatable shaft having a major axis extending through the center of and along the length of the rotatable shaft, magnet means mounted in a free end of said rotatable shaft, said rotatable shaft being mounted in a wear end of said pump, said wear end including a rotor, means for effecting rotation of said rotor and said shaft, means for circulating fluid from said pump end, through said wear end and back to said pump end, means for supporting said rotatable shaft having a first surface which remains stationary when said shaft is rotated, a portion of said first surface having a slot, means for exerting force on walls of said slot to move said impeller relative to said housing section axially in a direction defined by said major axis, said impeller and housing being structured to permit fluid to pass through said space when said impeller is rotated and said rotatable shaft, said magnet means, said impeller and apparatus mounted on said shaft positioned between said magnet means and said impeller being removable from said apparatus as a single unit.

* * * * *